United States Patent [19]

Saleck et al.

[11] 4,278,759

[45] Jul. 14, 1981

[54] PROCESS OF PREPARING PHOTOGRAPHIC SILVER HALIDE EMULSION

[75] Inventors: Wilhelm Saleck, Schildgen; Erich Wolff; Erwin Müller, both of Leverkusen, all of Fed. Rep. of Germany

[73] Assignee: AGFA-Gevaert A.G., Leverkusen, Fed. Rep. of Germany

[21] Appl. No.: 42,082

[22] Filed: May 24, 1979

Related U.S. Application Data

[63] Continuation of Ser. No. 845,137, Oct. 25, 1977, abandoned, which is a continuation of Ser. No. 657,217, Feb. 11, 1976, abandoned.

[30] Foreign Application Priority Data

Feb. 15, 1975 [DE] Fed. Rep. of Germany ..... 2506405

[51] Int. Cl.$^3$ ..... G03C 1/02

[52] U.S. Cl. ..... 430/627; 430/628

[58] Field of Search ..... 96/114; 430/627, 628

[56] References Cited

U.S. PATENT DOCUMENTS

| | | | |
|---|---|---|---|
| 3,700,456 | 10/1972 | Smith | 96/114 |
| 3,706,564 | 12/1972 | Hollister et al. | 96/114 |
| 3,852,073 | 12/1974 | Fitzgerald | 96/114 |
| 3,879,205 | 4/1975 | Fitzgerald | 96/114 |
| 4,030,292 | 6/1977 | Idel et al. | 96/114 |
| 4,033,772 | 7/1977 | Sprung et al. | 96/114 |

*Primary Examiner*—Jack P. Brammer

*Attorney, Agent, or Firm*—Connolly & Hutz

[57] ABSTRACT

A homo- or copolymer containing copolymerized monomeric units of the formula

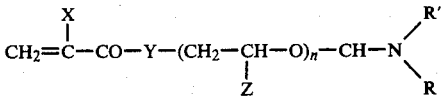

is a valuable peptizing agent for the precipitation of silver halide. Sensitivity, onset of development and silver covering power are advantageously influenced.

2 Claims, No Drawings

PROCESS OF PREPARING PHOTOGRAPHIC SILVER HALIDE EMULSION

This application is a continuation of the co-pending application Ser. No. 845,137 filed Oct. 25, 1977 for Photographic Silver Halide Emulsion, now abandoned, which was a continuation of U.S. application Ser. No. 657,217 filed Feb. 11, 1976, now abandoned.

This invention relates to a photographic silver halide emulsion with increased sensitivity which contains new polymers as sensitivity increasing additives.

The sensitivity of a photographic silver halide emulsion to light can be influenced in two ways. Firstly, the sensitivity can be increased by suitable choice of the physical conditions under which precipitation and the so-called physical ripening of the silver halide is carried out. In practice, there is a limit to the results which can be obtained in this way because the increase in sensitivity is accompanied by an increase in the silver halide grain size which deleteriously affects the quality of the final image. What is desired is a silver halide emulsion with a very high sensitivity and fine grain.

Secondly, the sensitivity of photographic emulsions can be increased chemically by the addition of compounds generally known as chemical sensitisers.

In principle, these compounds may be added at any stage in the preparation of the emulsion, for example they may be added as ripening additives before chemical ripening is carried out or they may be added to the finished casting solution after chemical ripening. Suitable ripening additives include, for example, noble metal salts, in particular gold salts, and sulphur compounds such as thiosulphates or organic, particularly heterocyclic sulphur compounds. One disadvantage of chemical sensitisation is that the increase in sensitivity is accompanied by an increased tendency of the emulsion to form a uniform developable fog. For this reason, very powerful chemical sensitisers such as compounds with an onium structure, e.g. quaternary ammonium and phosphonium salts or ternary sulphonium salts or polyalkylene oxides and polyalkylene oxide derivatives may only be added to the finished casting solution after chemical ripening. If the substances were added before chemical ripening, the photographic silver halide emulsions would be so heavily fogged that they could no longer be used.

Sensitivity increasing additives may also be added during precipitation of the silver halide, or precipitation may be carried out in the presence of such additives. Most of the chemical sensitisers, however, are unsuitable for this purpose for the reasons mentioned above, that is to say they either do not sensitise sufficiently or produce an excessively heavy fog.

Precipitation of the silver halide is generally carried out in the presence of gelatine, which has proved to be a particularly suitable binder for this purpose (peptisation agent) on account of its advantageous properties as a dispersing agent and protective colloid. In addition, gelatine acts as halogen acceptor in the photographic process and has excellent gel-forming properties as well as other advantageous properties which have led it to become the preferred binder for photographic silver halide emulsions.

However, it is difficult to produce gelatine of consistent quality and with constant physical and photographic properties. Most of its properties deteriorate in storage due to bacterial decomposition or, in the photographic process, due to hydrolysis. Furthermore, gelatine contains varying quantities of many different naturally occurring impurities, depending on its origin, and while some of these may have an advantageous effect, others may be deleterious. In addition, gelatine is subject to dimensional changes when exposed to varying conditions of temperature and moisture.

Since the photographic properties of a silver halide emulsion depend to a large extent on the precipitation conditions, there have been many attempts to replace gelatine by other suitable peptising agents, in particular by semisynthetic or fully synthetic substances such as synthetic polymers. On the whole, no substantial improvements could thereby be achieved. Thus, for example, phthalated gelatine as described in U.S. Pat. No. 2,614,928 has similar disadvantages to gelatine itself. Although polyvinyl pyrrolidone and polyvinyl alcohol are suitable as protective colloids, they considerably inhibit the growth of the grain. Copolymers of acrylamide and its derivatives have also been proposed as peptisation agents, in U.S. Pat. No. 2,811,494. It is, however, difficult to produce synthetic materials which are comparable to gelatine in their protective colloid action and stable to the pH changes which inevitably occur during preparation of the emulsion as well as being compatible with gelatine. Although most of the synthetic polymers described have a positive influence on certain mechanical properties such as, for example, the dimensional stability of the film and the swelling properties, this is usually achieved at the expense of the relationship between the sensitivity and the fineness of grain of the photographic materials. Moreover, the monomers required for the preparation of some of the polymers proposed can only be obtained by complicated, multistage processes.

It is an object of this invention to provide a binder for photographic silver halide emulsions which is suitable as peptisation agent and therefore capable of partly or completely replacing gelatine in the process of precipitation. The new binder should increase the sensitivity of the photographic silver halide emulsions without substantially coarsening the grain.

It should also improve the onset of development of the emulsion (lower induction period) and the covering power of the silver produced by development.

The invention relates to a photographic silver halide emulsion which is characterised by containing a homopolymer or copolymer of a compound of the following formula

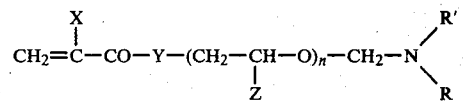

in which

X represents hydrogen or an alkyl group containing 1 to 6 carbon atoms, preferably methyl;

Y represents —NH—, $—NC_mH_{2m+1}—$(m=1 to 6) or —O—;

Z represents hydrogen or an alkyl group containing 1 to 4 carbon atoms, e.g. methyl or ethyl, R and R′ which may be the same or different represent each an alkyl group containing 1 to 18 carbon atoms or a cycloalkyl group containing 5 to 7 carbon atoms or R and R′ together with the nitrogen atom, may form a heterocyclic ring which may also contain other hetero atoms and n represents an integer of from 1 to 10, preferably 1 to 4.

Suitable comonomers are mainly water-soluble compounds, e.g. polymerisable compounds which contain carboxylic acid, sulphonic acid or phosphonic acid groups, for example acrylic acid, methacrylic acid, vinyl sulphonic acid, styrene sulphonic acid, allyl sulphonic acid, methallyl sulphonic acid, acrylamido-2-methyl propane sulphonic acid and salts of the above mentioned acids or vinyl pyrridine, vinyl methyl ether, acrylamide and methacrylamide.

In some cases, it may also be advantageous to incorporate a limited quantity, e.g. up to 20 mol %, of less water-soluble polymerisable monomers to achieve certain effects, for example to modify the elasticity and swelling properties. Acrylonitrile and acrylic acid esters are examples of such monomers.

The molecular weight of the homopolymers and copolymers used according to the invention is generally in the region of about 10,000 to 1,000,000. If the molecular weight is too low, the viscosity of the emulsion during its preparation is too low and the protective colloid effect is generally unsatisfactory. On the other hand, too high a molecular weight may result in reduced compatibility with other binders, e.g. gelatine. It is particularly preferred to use a polymer with a molecular weight of between 50,000 and 500,000.

This invention relates also to a process for the preparation of a photographic silver halide emulsion by precipitation and physical ripening of the silver halide in the presence of a peptisation agent, the emulsion being subsequently flocculated, washed if necessary, redispersed and chemically ripened, characterised in that precipitation of the silver halide, is carried out in the presence of a homopolymer or copolymer of a compound of the formula indicated above.

Copolymers of compounds of the above formula with acrylamide and acrylic acid have proved to be particularly useful.

The following are examples of monomers of the above formula: the reaction time and the initiator system. The polymerisation temperature generally does not extend 110° C. and is, in most cases, between 50° and 100° C. Polymerisation may be carried out in a suitable medium such as water or in mixtures of water and water miscible solvents such as methanol, ethanol-propanol, isopropanol or butyl alcohol. The concentration of the polymerisable monomers in the polymerisation mixture may be widely varied. Satisfactory results are obtained with concentrations of about 10 to 40% by weight, based on the whole polymerisation mixture. Examples of suitable catalysts include compounds which release free radicals, for example per compounds such as persulphates or porofores, that is to say azo compounds which are decomposed by heat, such as azodiisobutyronitrile (=Porofor N; Porofor is a trade mark) or redox polymerisation systems. Reference may be made in this connection to Houben-Weyl, Methoden der Organischen Chemie, 4th edition, 1961, volume XIV/1, page 209 et. seq. The polymers can be separated from the reaction mixture in known manner by freezing out, salting out, precipitation or any other suitable method.

Some examples of preparation of the polymers used according to the invention will now be given.

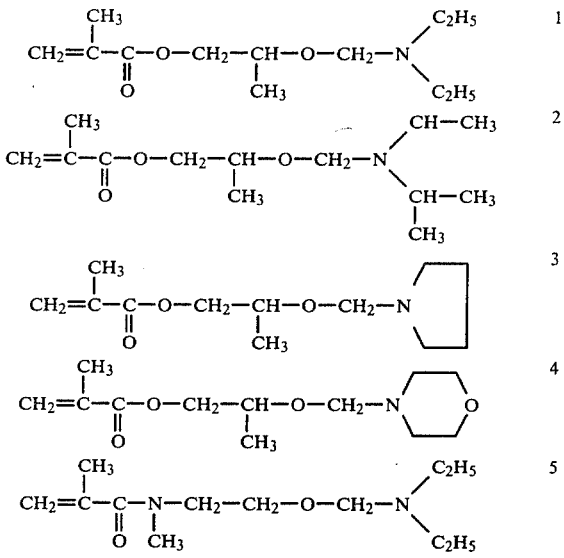

Preparation of the monomers have been described in German Offenlegungsschrift No. 2,358,761. The compounds are unsaturated O,N-acetals which have a polymerisable double bond and they can be homopolymerised or copolymerised by the usual methods, for example by solvent-free, solution or emulsion polymerisation, but for the preparation of photographic binders solution polymerisation and emulsion polymerisation processes are the most suitable. The temperature at which the polymers according to the present invention are prepared may vary within wide limits since the most suitable temperature depends on various factors such as the specific monomers used. Some of the polymers may be prepared as follows:

Polymer 1:

88 g of acrylamide,
7.85 g of monomer 1 and
3.40 g of distilled acrylic acid are dissolved in 500 ml of distilled water, and
80 ml of isopropyl alcohol and
400 mg of potassium persulphate are added. The solution is flushed with pure nitrogen for 15 minutes and then stirred under an atmosphere of nitrogen for 3 hours at 80° C. The polymer is then precipitated by introducing the highly viscous solution dropwise into acetone. The precipitate is dissolved in water and reprecipitated in acetone. The polymer obtained in this way is made up into an aqueous solution with a solids content of 14%.

Polymers 2 to 10 are prepared in a similar manner, using the monomers in the proportions shown in the following table:

TABLE

| Polymer | Acrylamide | Acrylic acid | Monomer 1 |
|---|---|---|---|
| 2 | 88 g | 1.0 g | 7.85 g |
| 3 | 88 g | 8.0 g | 7.85 g |
| 4 | 88 g | 12 g | 7.85 g |
| 5 | 88 g | 20 g | 7.85 g |
| 6 | 88 g | 40 g | 7.85 g |
| 7 | 88 g | 3.4 g | 4.0 g |
| 8 | 88 g | 3.4 g | 12 g |
| 9 | 88 g | 3.4 g | 20 g |
| 10 | 88 g | 3.4 g | 40 g |

Polymer 11

A copolymer is prepared as polymer 1 from 88 g of acrylamide, 3.4 g of acrylic acid and 7.85 g of monomer 2.

The polymers according to the invention are added to the photographic silver halide emulsions before they are chemically ripened, preferably while they are being precipitated. The quantity to be added depends on the effect desired and can be determined with a few simple tests in the usual manner. The binder used as protective colloid for precipitation of the silver halide may comprise for example 10 to 100% of the polymer according to the invention, and the remainder may be made up of gelatine. The polymers according to the invention are generally used in quantities of from 500 mg to 500 g, preferably 1 g to 200 g, per mol of silver halide to be precipitated. The substance to be used according to the invention are added in the form of their aqueous solutions. The concentration of substances in these solutions is not critical and may vary within wide limits. The polymers must be sufficiently soluble in water for the aqueous solution to be prepared in the required concentration. A concentration of from 1 to 5%, for example, is sufficient, but a more concentrated solution may, of course, be used, especially if the substances are readily soluble. The solutions are generally prepared at a pH of about 7 although the solution may be kept at a slightly acid pH, for example at pH 5 to 7, or in the case of so-called ammoniacal emulsions the pH of the solutions may be between 5 and 9.

The polymers are synthetic products of consistent quality. It is surprisingly found that they produce a considerable increase in sensitivity without substantially coarsening the silver halide grain. Other advantages are the rapidity of onset of the development of the silver halide emulsions and in some cases, also the increased covering power of the silver formed by development.

The substances according to the invention may be used in any silver salt emulsions, preferably in silver halide emulsions. The silver halides used may be silver chloride, silver bromide or mixtures thereof, which may have a small silver iodide content of up to 10 mol%. The silver halide may be dispersed in the usual hydrophilic binders, for example in carboxymethyl cellulose, polyvinyl alcohol, polyvinyl pyrrolidone, alginic acid and its salts, esters or amides or in proteins, preferably gelatine.

The emulsions may also contain other chemical sensitisers, for example quaternary ammonium and phosphonium salts and ternary sulphonium salts, reducing agents such as tin-II salts, polyamines as diethylene triamine or sulphur compounds as described in U.S. Pat. No. 1,574,944. The emulsions may also contain chemical sensitisers in the form of salts of noble metals such as rhutenium, rhodium, palladium, iridium, platinum or gold as described in the article by R. Koslowsky, Z. Wiss. Phot. 46, 65–72 (1951). The emulsions may also contain polyalkylene oxides or polyalkylene oxide derivatives as development accelerators or chemical sensitisers. An additional gain in sensitivity is thereby achieved.

The emulsions may be spectrally sensitised, for example with the usual monomethine or polymethine dyes such as acid or basic cyanines, hemi-cyanines, streptocyanines, merocyanines, oxonols, hemioxonols, styryl dyes and others, including also trinuclear or higher nuclear methine dyes such as rhodacyanines or neocyanines. Sensitisers of this kind have been described, for example, in the work by F. M. Hamer entitled "The Cyanine Dyes and Related Compounds", (1964), Interscience Publishers John Wiley and Sons.

The emulsions may contain the usual stabilisers, for example homopolar or salt-type compounds of mercury which contain aromatic or heterocyclic rings (for example mercapto triazoles), simple mercury salts, sulphonium mercury double salts and other mercury compounds. Azaindines are also suitable stabilisers, particularly tetra and pentaazaindines and especially those which are substituted with hydroxyl or amino groups. Compounds of this kind have been described in the article by Birr Z. Wiss. Phot. 47, 2–27 (1952). Other suitable stabilisers include heterocyclic mercapto compounds, e.g. phenyl mercaptotetrazole, quaternary benzothiazole derivatives, benzotriazole and the like.

The emulsions may be hardened in the usual manner, for example with formaldehyde or halogenated aldehydes which contain a carboxyl group, such as mucobromic acid, diketones, methane sulphonic acid esters, dialdehydes and the like or polyfunctional triazine derivatives such as trisacrylolhexahydrotriazine or halogenated or alkoxy-substituted hexahydrotriazine derivatives.

The compounds according to the invention have their advantageous effect not only in black and white emulsions but also in the production of colour photographic images. They have good compatibility with the usual colour couplers. They may also be used for direct positive emulsions, for example those with a layered grain structure described in French patent specification No. 1,585,791. They are also suitable for emulsions used for the silver dye bleaching process or dye diffusion process.

The polymers are also particularly effective in silver halide emulsions which are precipitated in the presence of silicate sols. The preparation of such emulsions have been described in German Offenlegungsschrift No. 1,797,254 and U.S. Pat. No. 3,637,391.

According to another preferred embodiment of the invention, the polymers are used in combination with polymers which contain disulphonimide groups. These compounds have been described in German Patentschrift No. 1,089,548 and U.S. Pat. No. 3,052,656. The polymeric disulphonimides are added before chemical ripening, particularly when the flocculate is being precipitated. The concentration of the disulphonimides may vary within wide limits. It has generally been found sufficient to use 1 to 10%, based on the whole quantity of binder used during precipitation.

EXAMPLE 1

Sample 1

The following solutions were prepared for producing a silver iodobromide gelatine emulsion:

| | | |
|---|---|---|
| Solution A | 1000 ml of water<br>10 g of gelatine<br>30 g of KBr<br>2 g of KI | temperature 50° C. |
| Solution B | 1000 ml of water<br>40 g of $AgNO_3$ | temperature 45° C. |

Solution B was added steadily to solution A over a period of 5 minutes and the mixture was digested for 30 minutes at 50° C. and cooled to 20° C. 10 ml of a 10% aqueous polystyrene sulphonic acid solution was then added and the emulsion was flocculated by reducing the pH to 3.0 with sulphuric acid (25%). The flocculate was left to settle and the supernatant solution was poured off. For chemical ripening, the flocculate was dissolved in 2000 ml of a 10% aqueous gelatine solution (pH 7.5) at 40° C.

When the flocculate had been dissolved, it was adjusted to pH 6.5, a suitable quantity of sulphur ripener and gold salts was added and the solution was ripened to full sensitivity at 55° C. 10 ml of a 5% aqueous solution of saponine (wetting agent), 10 ml of a 10% aqueous solution of formaldehyde (hardener) and 20 ml of a 1% methanolic solution of 4-hydroxy-6-methyl-1,3,3a,7-tetraazaindene (stabiliser) were added per kg of emulsion, and the mixture was then cast on a cellulose acetate substrate. The emulsion was assessed sensitometrically after exposure in a conventional sensitometer behind a step wedge and development (7 and 16 minutes at 20° C.) in a developer of the following composition:

| | |
|---|---|
| Sodium sulphite sicc. | 70.0 g |
| borax | 7.0 g |
| hydroquinone | 3.5 g |
| p-monomethylaminophenol-sulphate | 3.5 g |
| sodium citrate | 7.0 g |
| potassium bromide | 0.4 g |
| made up with water to 1 liter. | |

Samples 2–12

Preparation of the emulsion and sensitometric assessment were carried out in the same way in each case but 50% of the gelatine in solution A was replaced successively by the same weight of one of the polymers 1 to 11 described above.

Table 2 below shows that emulsions 2 to 12 (containing polymers 1 to 11) were more sensitive than the comparison emulsion.

TABLE 2

| | 7 minutes development | | | 16 minutes development | | |
|---|---|---|---|---|---|---|
| Sample | Sensitivity °DIN | γ | Fog | Sensitivity °DIN | γ | Fog |
| 1 | Standard | 0.85 | 0.07 | Standard | 1.10 | 0.08 |
| 2 | +2.0 | 1.30 | 0.06 | +2.0 | 1.50 | 0.08 |
| 3 | +1.0 | 0.95 | 0.10 | +0.5 | 1.20 | 0.11 |
| 4 | +1.0 | 0.90 | 0.11 | +1.5 | 1.15 | 0.14 |
| 5 | +0.5 | 1.00 | 0.10 | +0.5 | 1.25 | 0.15 |
| 6 | +0.5 | 0.90 | 0.09 | +0.5 | 1.25 | 0.13 |
| 7 | +1.5 | 0.85 | 0.07 | +1.5 | 1.00 | 0.13 |
| 8 | +2.0 | 0.90 | 0.13 | +2.0 | 1.10 | 0.17 |
| 9 | +1.0 | 1.00 | 0.18 | +1.0 | 1.20 | 0.24 |
| 10 | +1.5 | 0.90 | 0.15 | +2.0 | 1.10 | 0.23 |
| 11 | +2.0 | 0.90 | 0.06 | +2.5 | 1.10 | 0.10 |
| 12 | +1.5 | 0.90 | 0.04 | +1.5 | 1.15 | 0.04 |

3° (DIN) = 1 shutter stop

EXAMPLE 2

Sample 1

The same silver iodobromide gelatine emulsion as sample 1 of example 1 was prepared as comparison emulsion.

Samples 2 to 10

These samples were prepared by the same method as sample 1 but the *whole* quantity of gelatine used in solution A was replaced in each case by equal quantities by weight of one of the polymers 1 to 5 and 7 to 10 previously described.

After precipitation of the silver halide, 10 g of gelatine were added in the form of a 10% aqueous solution and the emulsion was then flocculated by the addition of polystyrene sulphonic acid and reduction of the pH to 3.0 with sulphuric acid.

| | 7 minutes development | | | 16 minutes development | | |
|---|---|---|---|---|---|---|
| Sample | Sensitivity °DIN | γ | Fog | Sensitivity °DIN | γ | Fog |
| 1 | Standard | 0.80 | 0.08 | Standard | 1.05 | 0.10 |
| 2 | +4.5 | 0.10 | 0.15 | +4.0 | 1.15 | 0.30 |
| 3 | +3.0 | 0.70 | 0.10 | +3.0 | 0.80 | 0.13 |
| 4 | +2.5 | 0.85 | 0.12 | +3.0 | 1.00 | 0.18 |
| 5 | +2.5 | 0.90 | 0.15 | +2.5 | 1.00 | 0.22 |
| 6 | +3.0 | 0.70 | 0.11 | +3.5 | 0.85 | 0.16 |
| 7 | +2.5 | 0.75 | 0.10 | +2.0 | 0.95 | 0.14 |
| 8 | +3.0 | 0.95 | 0.08 | +2.5 | 1.15 | 0.12 |
| 9 | +3.0 | 0.85 | 0.11 | +3.5 | 1.20 | 0.15 |
| 10 | +3.0 | 0.65 | 0.11 | +3.0 | 0.75 | 0.17 |

3° (DIN) = 1 shutter stop

Both tables show the surprising increase in sensitivity, which is greatest when 100% of the gelatine is replaced by polymer substance.

The range of application of the invention is not restricted to the examples given above but can be extended to any type of emulsion and all possible silver halide compositions.

We claim:

1. In the process for the preparation of a photographic silver halide emulsion by precipitation and physical ripening of the silver halide in the presence of a peptisation agent, followed by flocculation of the emulsion, washing if necessary, redispersion and chemical ripening, the improvement according to which the precipitation of the silver halide is carried out in the presence of a hydrophilic colloid binder for the silver halide emulsion containing from 50% to 100% of a homopolymer of the compound of the following formula:

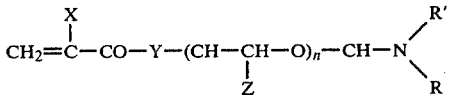

in which

X represents hydrogen or an alkyl group containing 1 to 6 carbon atoms,

Y represents —NH—, $—NC_mH_{2m+1}—$(m=1–6) or —O—,

Z represents hydrogen or an alkyl group containing 1 to 4 carbon atoms,

R and R′ may be the same or different and represent an alkyl group containing 1 to 18 carbon atoms or a cycloalkyl group containing 5 to 7 carbon atoms or R and R′ together with the nitrogen atom may represent a heterocyclic ring which may also contain other heteroatoms, and n represents an integer of from 1 to 10 or, a copolymer of a monomer mixture with 2 to 50 mol% of a compound of the following formula:

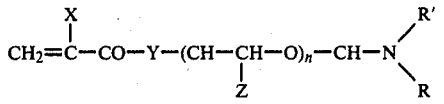

in which

X represents hydrogen or an alkyl group containing 1 to 6 carbon atoms,

Y represents —NH—, —$NC_mH_{2m+1}$—(m=1-6) or —O—,

Z represents hydrogen or an alkyl group containing 1 to 4 carbon atoms,

R and R′ may be the same or different and represent an alkyl group containing 1 to 18 carbon atoms or a cycloalkyl group containing 5 to 7 carbon atoms or R and R′ together with the nitrogen atoms may represent a heterocyclic ring which may also contain other heteroatoms, and n represents an integer of from 1 to 10 the remainder of said binder made up with protective colloid, said homopolymer or said copolymer having a molecular weight ranging from 10,000 to 1,000,000, wherein said compound of said formula when used to form a copolymer is copolymerized essentially with a comonomer which is a water soluble polymerizable monomer compound selected from the group consisting of vinyl pyrridine, vinyl methyl ether, acrylamide and methacrylamide, and compounds of carboxylic acid, sulfonic acid, phosphonic acid and acrylic acid, said emulsion containing said homopolymer or said copolymer in an amount of from 1 g to 200 g per mol o silver halide.

2. Photographic silver halide emulsion as claimed in claim 1, which contains a homopolymer or copolymer of a compound of the following formula

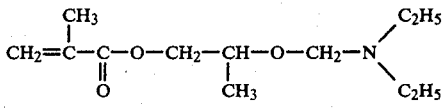

* * * * *